US006079574A

United States Patent [19]

Mylander et al.

[11] Patent Number: 6,079,574

[45] Date of Patent: Jun. 27, 2000

[54] DISPLAY AND STORAGE SYSTEM

[75] Inventors: Paul H. Mylander, North Attleboro, Mass.; Joan T. Roth, Providence; Mike Banaczuk, Warwich, both of R.I.; James Tennant, Braintree, Mass.

[73] Assignee: Intercraft Company, Statesville, N.C.

[21] Appl. No.: 09/236,796

[22] Filed: Jan. 25, 1999

[51] Int. Cl.[7] ..... A47F 5/13

[52] U.S. Cl. ..... 211/106

[58] Field of Search ..... 211/106, 59.2, 211/59.1, 57.1, 181.1, 195, 184, 54.1; D6/566

[56] References Cited

U.S. PATENT DOCUMENTS

| | | | |
|---|---|---|---|
| D. 169,649 | 5/1953 | Zel et al. | D6/566 |
| D. 191,484 | 10/1961 | Bardo et al. | D6/566 |
| D. 321,804 | 11/1991 | Wolff et al. | D6/566 |
| D. 351,844 | 10/1994 | Chesser | D6/566 |
| D. 380,638 | 7/1997 | Cohen et al. . | |
| 2,331,361 | 10/1943 | Tuttle et al. . | |
| 2,643,002 | 6/1953 | Rubentein | 211/106 |
| 2,706,517 | 4/1955 | Dexter et al. . | |
| 2,793,760 | 5/1957 | Zel et al. . | |
| 2,815,854 | 12/1957 | McKenna . | |
| 3,114,459 | 12/1963 | Kersting . | |
| 3,302,797 | 2/1967 | Kolster . | |
| 3,595,404 | 7/1971 | Goldstein . | |
| 3,777,896 | 12/1973 | Ehrlich . | |
| 3,780,873 | 12/1973 | Silva . | |
| 3,880,292 | 4/1975 | Kitchen . | |
| 3,978,799 | 9/1976 | Escalette . | |
| 4,074,451 | 2/1978 | Jacobson et al. . | |
| 4,191,160 | 3/1980 | Elliott | 211/181.1 |
| 4,238,035 | 12/1980 | Kassanchuk | 211/181.1 |
| 4,248,352 | 2/1981 | White | 211/106 |
| 4,498,592 | 2/1985 | Colucci . | |
| 4,678,086 | 7/1987 | Nervig et al. . | |
| 4,694,966 | 9/1987 | Soenson et al. | 211/106 |
| 4,742,923 | 5/1988 | Calvert | 211/59.1 |
| 4,895,334 | 1/1990 | Bajek et al. | 211/181.1 X |
| 4,913,297 | 4/1990 | Wells . | |
| 5,169,010 | 12/1992 | Fortner | 211/181.1 |
| 5,205,208 | 4/1993 | Gongwer | 211/181.1 |
| 5,213,221 | 5/1993 | Raye, Sr. | 211/181.1 X |
| 5,257,702 | 11/1993 | Grafstein . | |
| 5,287,974 | 2/1994 | Buday | 211/184 |
| 5,397,087 | 3/1995 | Teece | 211/106 |
| 5,435,295 | 7/1995 | Gerrard | 211/181.1 |
| 5,449,076 | 9/1995 | Van Noord | 211/106 |
| 5,553,724 | 9/1996 | Moher et al. . | |
| 5,775,209 | 7/1998 | Tiemann | 211/181.1 X |
| 5,806,688 | 9/1998 | Adenau et al. . | |
| 5,810,299 | 9/1998 | Poulos . | |
| 5,815,970 | 10/1998 | Thalenfeld et al. . | |
| 5,836,459 | 11/1998 | Nezwek et al. . | |
| 5,855,282 | 1/1999 | Hardy | 211/59.1 |

*Primary Examiner*—Daniel P. Stodola
*Assistant Examiner*—Jennifer E. Novosad
*Attorney, Agent, or Firm*—Foley & Lardner

[57] ABSTRACT

A display and storage system useful for objects, such as photo albums and frames, includes a first storage portion and a second display portion pivotally secured to the first portion. The storage portion comprises a vertical side and a bottom. The display portion is constructed to receive and display a single one of the items to allow a consumer to examine the item. Once a buying decision has been made, the display portion is opened relative to the storage portion to permit the consumer to remove one or more fresh, saleable products. In the illustrated and preferred embodiment, both portions are made from wire. Also, the display and storage device is preferably tilted with respect to the vertical support surface to ensure that the display portion will self close. The system may also comprise a plurality of the display and storage devices arranged together so that the side of the storage portion of one device acts as a containment wall for product stored in an adjoining device. A wall component is provided for being attached perpendicularly to the vertical support wall and to act as a containment surface for an outermost display and storage device.

39 Claims, 5 Drawing Sheets

DISPLAY AND STORAGE SYSTEM

CROSS-REFERENCES TO RELATED APPLICATIONS, IF ANY

None

BACKGROUND OF THE INVENTION

1. Field of the Invention

The present invention relates generally to the field of displays and more particularly to a storage and display device useful for retail establishments and for products where a customer is likely to examine a product prior to making a purchase decision. Still more specifically, the present invention relates to a display and storage device useful for objects including, but not limited to, photo albums and picture frames in which a single one of the items is displayed for the consumer and, after a purchase decision is made, the device may be opened to allow the consumer to remove one or more fresh and saleable products. In its most preferred form, the present invention relates to a system including a plurality of display and storage devices, each made from wire and each being attached to peg board or slat wall surfaces or other surfaces commonly found in retail establishments.

2. Description of the Prior Art

A large variety of display techniques are known, including shelves and peg board with various rods and brackets attached thereto for the display of individual items or groups of items. For the display of photo albums and picture frames, for example, the most common technique employed today is to merely place a plurality of the items on the shelf for examination and purchase by the customer. These types of products typically invoke a comparison shopping urge in the customer, and typically a plurality of products will be removed from the shelf, examined by the customer and replaced before a final purchase decision is made. Because there are typically numerous sizes, colors, and brands of such products displayed at a store, and since customers typically do not take the time to carefully replace a particular product from the exact location from which it was initially removed, clutter results where product styles may become intermixed and become less attractive to the consumer. Using photo albums as an example, the customer may examine several varieties before making purchase decisions, and then may decide to buy additional refill pages for an album that has been selected. If the albums have become intermixed with albums of other styles or brands, the selection of an appropriate refill also becomes more difficult.

The problems mentioned to this point relate primarily to those encountered by or caused by the customer, but the purchasing habits of customer for these types of products also create problems for the retailer who must rearrange the display and maintain appropriate inventories of both the original product and, in the case of photo albums, refills. These processes become time consuming and expensive.

A display and storage system which allows customers to examine a product and which prevents the product intermingling discussed above, and which further provides for orderly and simplified inventory management for the retailer would represent a very substantial advance in this field of invention.

FEATURES AND SUMMARY OF THE INVENTION

A primary feature of the present invention is to provide a display and storage system which overcomes the above-noted disadvantage of existing display systems.

Another feature of the present invention is to provide a display and storage system which may be adapted to a wide variety of products of different sizes.

A further feature of the present invention is to provide a display and storage system which may comprise a plurality of individual display and storage devices, allowing the system to be adapted to a variety of space requirements and which may be arranged in both the horizontal and vertical arrays.

Yet another feature of the present invention is to provide a display and storage system which may be constructed from inexpensive materials and which employs individual display and storage devices which may be of different sizes to increase the capacity to display and store a variety of items of different sizes.

A different feature of the present invention is to provide a display and storage system which reduces store clutter and facilitates inventory management by retailers.

Another feature of the present invention is to provide a display and storage system which allows a customer to closely examine an item, make a purchase decision and then easily retrieve fresh and saleable product from the storage portion of the system.

Another feature of the present invention is to provide a display and storage system which may be mounted on peg board or other display surfaces already in use in retail establishments.

How the foregoing and other features of the invention are accomplished will be described in the following detailed description of the preferred and an alternate embodiment of the invention, taken in conjunction with the drawings. Generally, however, they are accomplished in a display and storage system which may include as few as one or a plurality of individual display and storage devices, each of which including a storage portion and a display portion. The storage portion preferably includes a single vertical side and a bottom sized to hold a plurality of the items therein. When a plurality of the devices are used together, a side of a first device will act as a containment surface for the adjoining storage portion of an adjoining device. The display portion includes a cradle or other structure to support and display a single item for examination by the customer, with the item either being loosely held within the cradle or permanently attached to the display portion for examination by the customer. The display portion of each device is pivotal, using a hinge, to allow the consumer to open the display portion and remove fresh and saleable product from the storage portion once a purchasing decision has been made. In the most preferred embodiments, the display and storage portions are each constructed from wire, and the device is tilted with respect to the vertical to create a self-closing feature for the display portion. Also the display portion is preferably hinged from the side in a manner which allows the consumer to open the display portion a sufficient amount to remove product without interfering with adjacent display and storage devices during the product removal operation. Other ways in which the features of the invention are accomplished will become apparent to those skilled in the art after they have read the following specification, such other ways falling within the scope of the present invention if they fall within the scope of the claims which follow.

DESCRIPTION OF THE DRAWINGS

In the various FIGURES, like reference numerals are used to indicate like components.

DETAILED DESCRIPTION OF THE PREFERRED AND ALTERNATE EMBODIMENT

Before proceeding with the detailed description of the preferred and an alternate embodiment, several general comments can be made about the applicability and the scope of the present invention.

First, while photo albums are used as the illustrative product to be displayed and stored, it will soon become apparent that the display and storage system of the present invention can be used with a wide variety of products. The invention has its greatest applicability for the sale of products a consumer likes to physically inspect before making a purchasing decision, such as albums and frames. But the invention can be used with a wide variety of boxed or unboxed product. For example, an unboxed product can be displayed, while fresh and saleable boxed or wrapped product is located in a storage portion and is readily accessible for the customer once the purchasing decision is made.

Second, the display and storage device of the most preferred embodiment is prepared from wire, but other materials such as wood or plastics could be used for one or both components. For example, the display portion could be prepared from wire while the storage portion could be prepared from wood, such as particle board.

Figure 4:
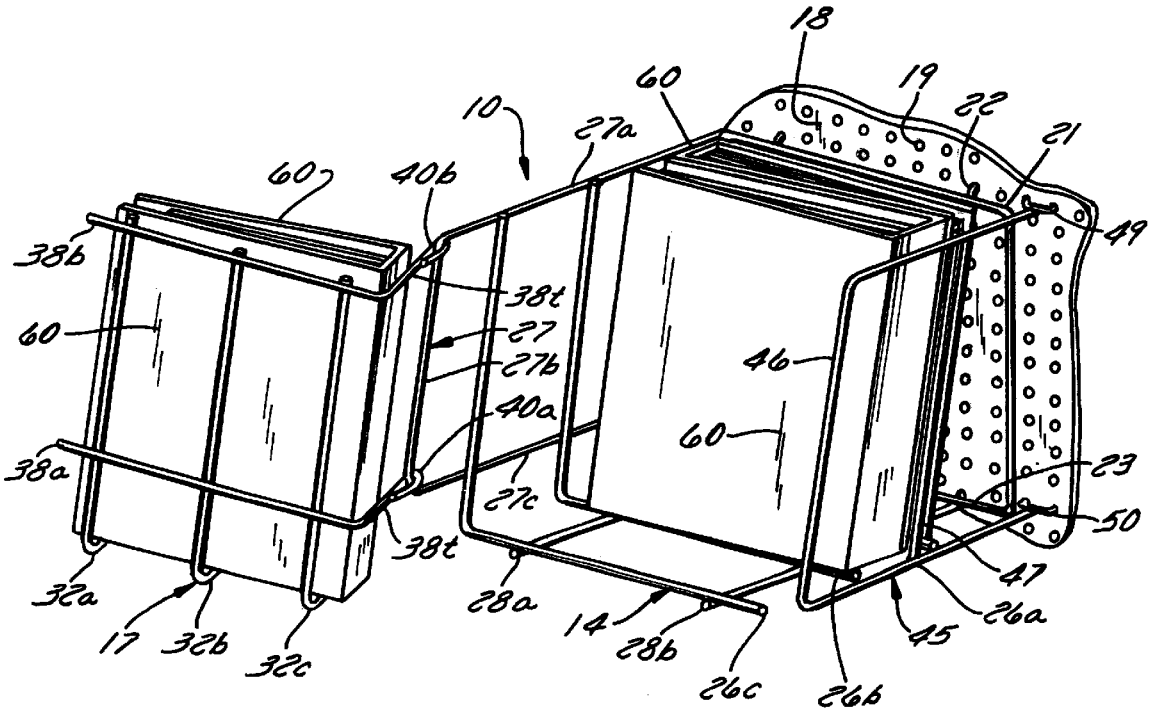
FIG. 4 is a perspective view of the display and storage devices of FIGS. 1 and 2, with product included and with the display portion open.
Figure 5:
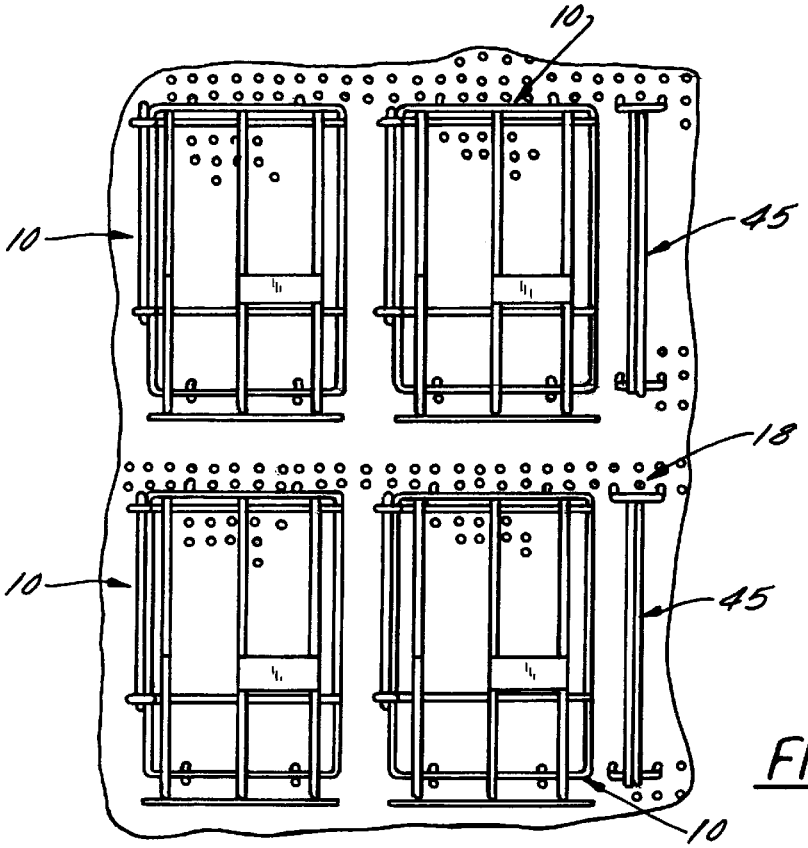
FIG. 5 is a front view of a system including four storage and display devices as shown in FIG. 1, together with a pair of wall elements for each of the two horizontal rows.

Third, the system shown in FIGS. 4 and 5 are comprised of individual display and storage device s of a common size, but a variety of different sizes could be employed to create display arrays for products of a wide variety of sizes. Each individual display device, can, itself, accommodate product of different sizes, a general rule being that the bottom should be wider than ½ the width of products. Moreover, dimensions are not critical and can be selected by the manufacturer to fit both the product and the display environment in which the product will be sold. In many retail establishments, the display and storage device should have a depth comparable to the depth of shelving to prevent the front portion of the display and storage device from extending into an aisle. Standard shelf dimensions typically are in the range of twelve to twenty inches (12"–20"), and accordingly, an overall depth for this display device in the range of twelve to twenty inches (12"–20") is most preferred.

Fourth, while the albums are stored in a horizontal position in the illustrations, product could also be stored vertically. The bottom would function like a bookshelf for photo albums, the splines of the albums facing outwardly for removal by the customer. These comments would apply to products of other shapes and sizes as well as to photo albums.

Fifth, the preferred and alternate embodiments s how respectively side and top hinging of the display portion to the storage portion. Hinging could also be accomplished from the bottom using lift and rotate systems known in the wire storage art, or the like.

Sixth, the display and storage system of the present invention is illustrated in connection with peg board display walls, but the device could easily be adapted to slat walls or other types of display surfaces without departing from its intended scope. Moreover, the illustrated embodiments show L-shaped storage portions, using a portion of an adjacent display or a separate wall element to contain product if necessary. Additional wiring could be used. For example, a U-shaped storage compartment with two side walls could be employed with the hinged display portion attached to either side or the bottom thereof.

Seventh, the particular technique for attaching the storage area to the vertical wall in the display area can be widely varied and involve techniques known in the wire closet and shelving system art, the peg board art and the like. Accordingly, the number of attachment brackets and the location thereof can be varied depending on the overall shape and size of the system components and the amount of weight which would be expected to be supported on the bottom of any individual display and storage device.

Eighth, the particular display portion shown in the illustrated embodiment is a cradle which removably supports a photo album. The customer may remove the book entirely, open it and examine the photo album pages, the overall design, the capacity and the like and then replace the album in the cradle. Once the purchasing decision is made, the display portion is opened to allow removal of product stored behind the displayed album. In photo album applications or in other applications of the present invention, it may be desirable to secure the product in the display area so that it may be examined from the outside and from the front and back, but not be removed. This can be accomplished by providing a strap or chain between an internal component of the product and a component of the display portion, or by physically surrounding the displayed item by components of the display portion, such as wiring components.

Figure 1:
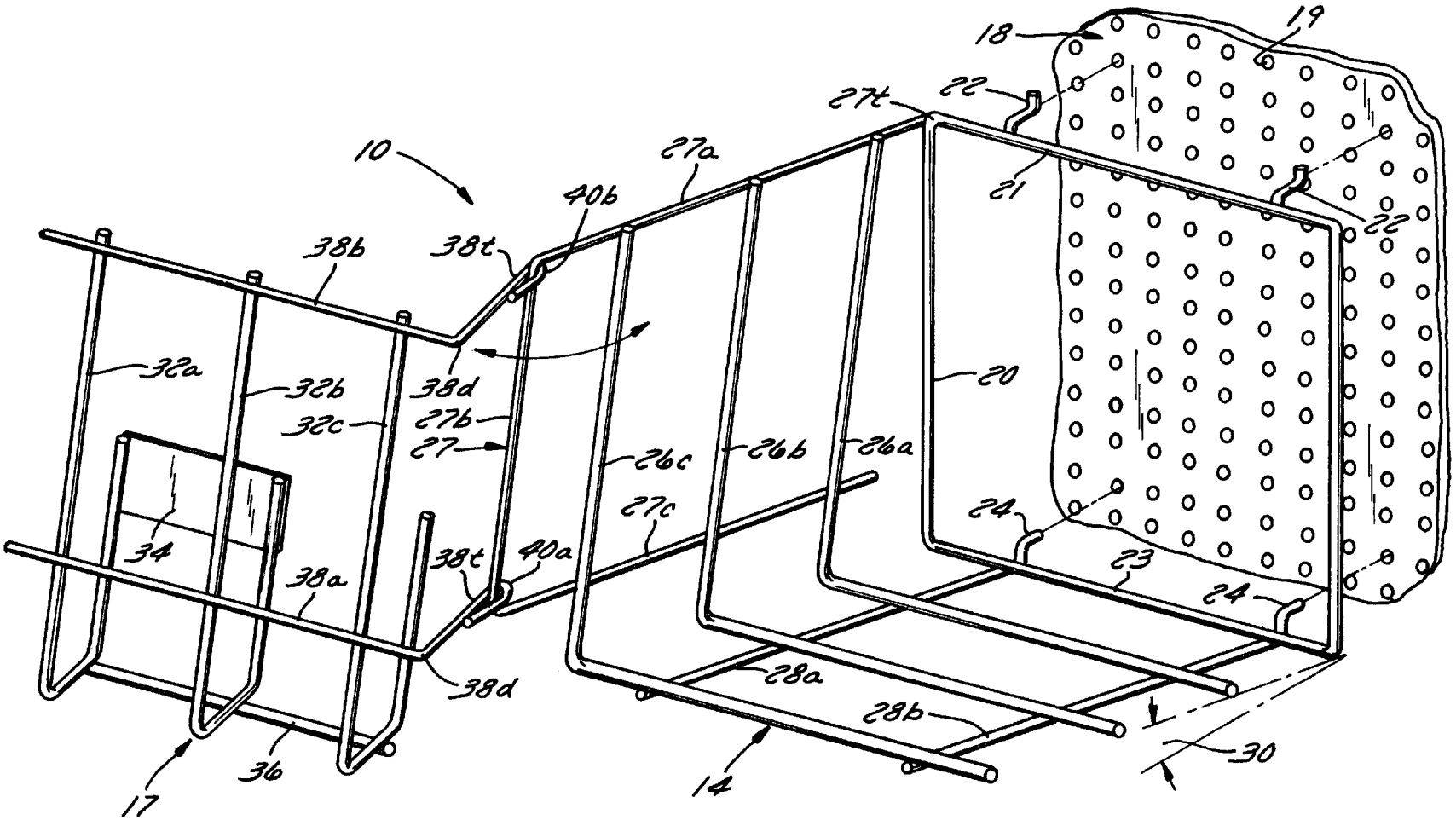
FIG. 1 is perspective view of a single display and storage device according to the most preferred form of the present invention, showing the display portion in its open position.

Proceeding now to a description of the FIGURES and the most preferred embodiment and an alternate thereof, FIG. 1 shows a display and storage device 10 having a storage portion 14 and a display portion 17, this particular FIGURE showing the display portion 17 in its open position. "Open position" as the term is used herein will mean the position which allows a customer to remove a product from storage portion 14.

The storage portion is mounted on a peg board wall 18 having a plurality of holes 19 therein. The holes may be on one inch (1") centers or other hole distributions known in the peg board art.

The rear edge of display portion 14 is defined by a rectangular frame 20 constructed out of wire rod stock. At the top side 21 of frame 20, a pair of peg board hooks 22 are located in a spaced apart relationship and adapted to engage two holes 19 of the peg board wall 18. Extending below the lower side 23 of frame 20 are a pair of pegs 24 which actually are extensions of wire rods which will be described shortly.

Storage portion 14 is shaped generally in an "L" shape when viewed from the front and is defined by a series of wire rods, each which will now be described. First, three wire rods 26*a*, 26*b*, and 26*c* which are themselves L-shaped and which are parallel to each other extend along the left side wall and bottom of storage portion 14. They are fixed in this spaced apart relationship by three wire rods 27, 28*a* and 28*b*. Wire rod 27 is a generally U-shaped and has a terminal end 27*t* coupled to the upper left hand corner of frame 20. One leg 27*a* of U-shaped wire rod 27 is welded to the top of the rods 26*a*–26*c*, and the base 27*b* of rod 27 extends outwardly from rod 26*c* by several inches, two inches (2") being preferred. The other leg 27*c* returns toward, but does not extend all the way to, frame element 20, welds being provided between leg 27*c* of rod 27 and wire rods 26*a*–26*c*.

Wire rods 26*a*–26*c* are also secured in their parallel and spaced apart relationship by a pair of bottom wire rods 28*a* and 28*b* which extend from rod 26*c* along the bottom of storage portion 14 toward peg board 18 and terminate in the aforementioned pegs 24. Rods 28*a* and 28*b* are welded to rods 26*a*–26*c* and to the bottom 23 of frames 20 to provide a strong construction for storage portion 14.

Figure 2:
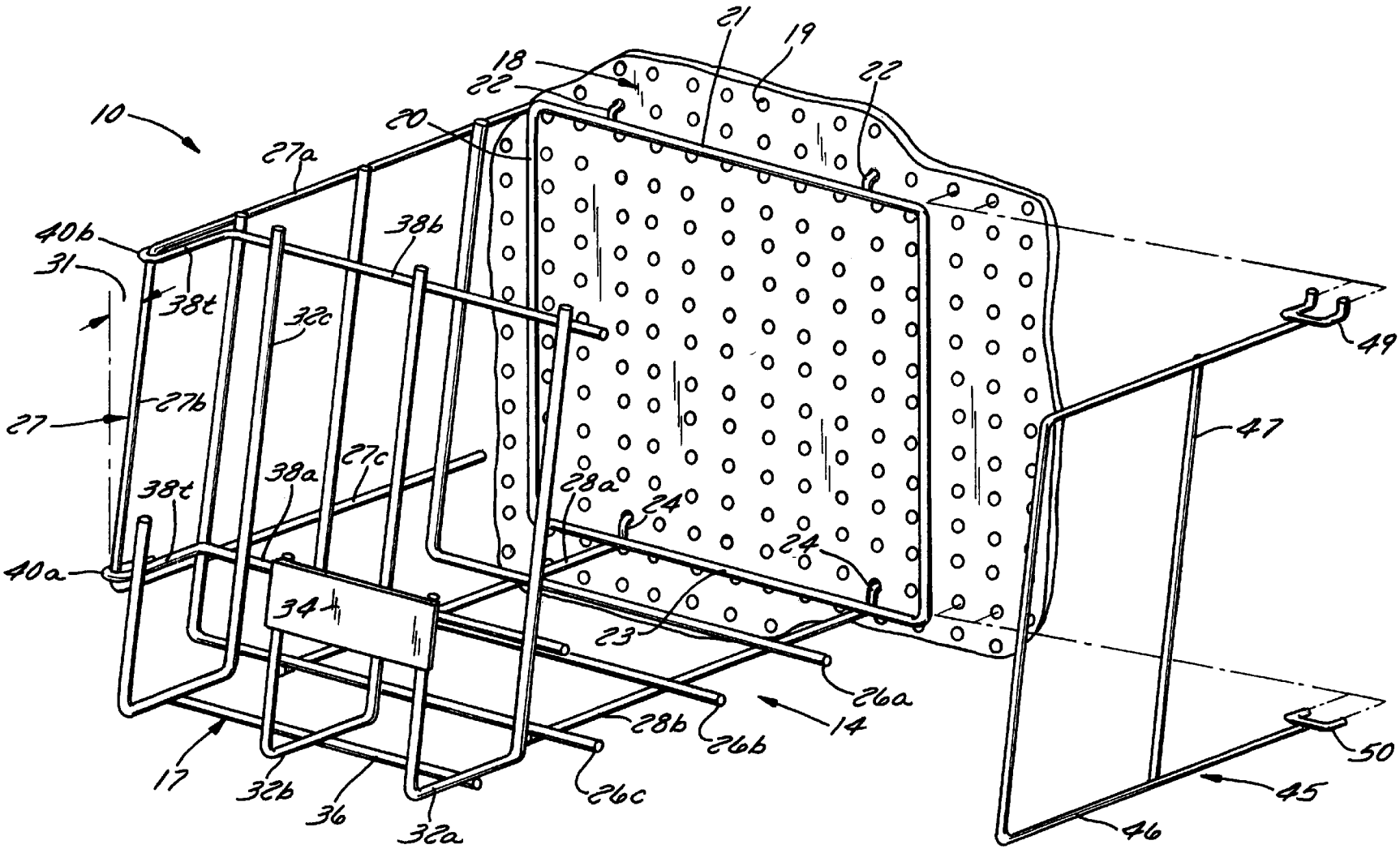
FIG. 2 is a perspective view of the device shown in FIG. 1 with the display portion in its closed position and also showing a planar wall element which may optionally be used with the device.

Display portion 17 is mounted for pivotal rotation about the bottom 27*b* of rod 27 as indicated by the arrow in FIG. 1. Reference to FIGS. 1 and 2 will be helpful in understanding display portion 17, FIG. 2 showing it in its closed position. Display portion 17 is also made from wire, including three vertical "J" shaped wire rods 32*a*, 32*b* and 32*c* which have an overall length slightly exceeding the height of rods 26*a*–26*c* in storage portion 14. Rods 32*a*–32*c* are held in their parallel and spaced apart relationship by a wire rod 36 welded to the bottom portion of the "J" of each of the rods 32*a*–32*c*, the bottom of the "J" being straight in the preferred and illustrated embodiment. Wire rods 32*a*–32*c* are also held in their parallel and spaced apart relationship by a pair of spaced apart horizontal rods 38*a* and 38*b*, each of which extends behind rods 32*a*–32*c* and are welded to them at the points of intersection. Rods 38*a* and 38*b* each include a bend 38*d* of approximately 90° and creating a short L-shaped extension 38*t* for both. The free ends of extensions 38*t* are bent into J hooks 40*a* and 40*b* which surround leg 27*b* of rod 27 of storage portion 14 to permit horizontal rotation of the display portion 17 between the two positions shown in FIGS. 1 and 2.

The storage portion 14 is preferably provided with a slight upward incline as indicated by the angle 30 in FIG. 1. With such an incline and with an object in the display portion 17, the display portion 14 will return, under the force of gravity, to the position shown in FIG. 2. Another way in which this may be accomplished, and which is illustrated best in FIG. 2, is to have a slight rearward incline for leg 27*c* of rod 27. Either or both approaches may be utilized to achieve a gravitational closure.

Before leaving the description of the display and storage device 10, reference can be made to FIG. 1 or 2 to note a plate 34 coupled to the upper ends of the shorter portion of wire rods 32*a* and 32*b*. Plate 34 provides a location for pricing and/or brand identification for the product to be displayed and stored.

A planar wall element 45 is shown in FIG. 2, which may be used in conjunction with display and storage devices 10. Wall element 45 is constructed from a U-shaped wire rod 46 having a cross member 47 welded thereto and terminating at its upper end in a bracket 49 having two hooks for being inserted into peg board 18 and terminating at its lower end in a bracket 50 having a pair of pegs for being inserted into adjoining horizontal holes 19. It will be appreciated by reference to further illustrations that the planar wall element 45 may be located a sufficient distance to the right of a display and storage device 10 to assist in confining product between the side wall of the storage portion 14 and the planar wall element 45. The bottom of support portion 14 should generally have a width sufficient to support objects to be displayed and stored, a general rule of thumb being that the bottom width should exceed ½ the width of the items. The planar element 45 will assist in supporting elements or product which might be stacked in such a manner that they might spill outwardly to the right, were it not for the use of planar wall elements 45.

Figure 3:
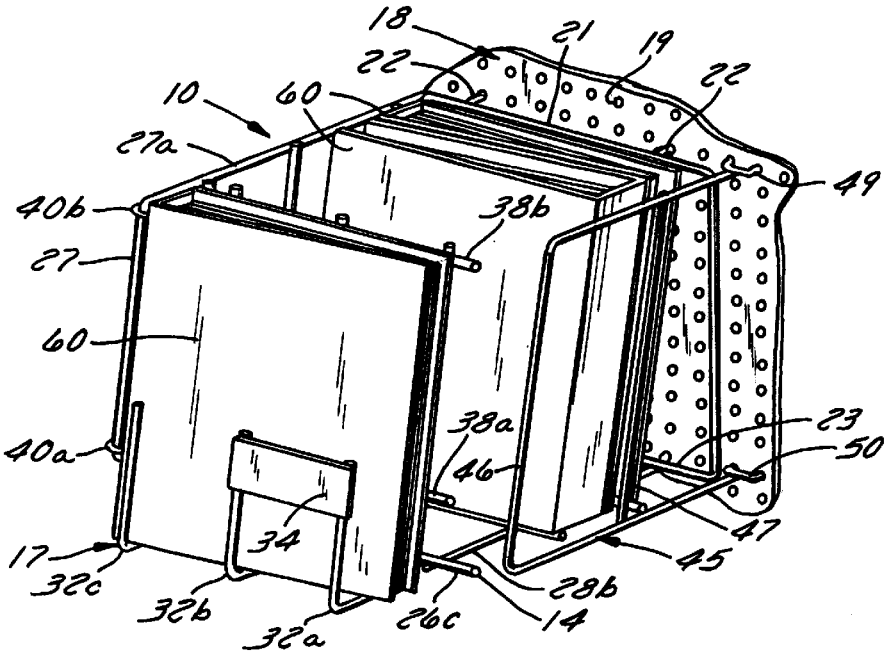
FIG. 3 is a perspective view of the display and storage devices of FIGS. 1 and 2, with product included and with the display portion closed.

FIG. 3 illustrates use of the display and storage devices 10 in conjunction with photograph albums 60. A first one of the albums is located in the display portion 17 and is supported by the flat bottoms of the J-shaped wire rods 32*a*–32*c*. Other albums 60 are located in the storage portion 14, and are confined between the side wall of portion 14 and the planar wall element 45 just described. It should also be appreciated that the items which may be inspected by the customer and which are located in display portion 17 may be removed therefrom, opened, examined and replaced at the whim of the consumer. Once a purchasing decision has been made, the display portion 17 is moved to the position shown in FIG. 4,for removal of fresh, saleable product 60 from storage portion 14. It can also be noted in these FIGURES that the construction of the hinge permits rotation of display portion 17 without interference with another, adjacent display and storage device 10.

Figure 6:
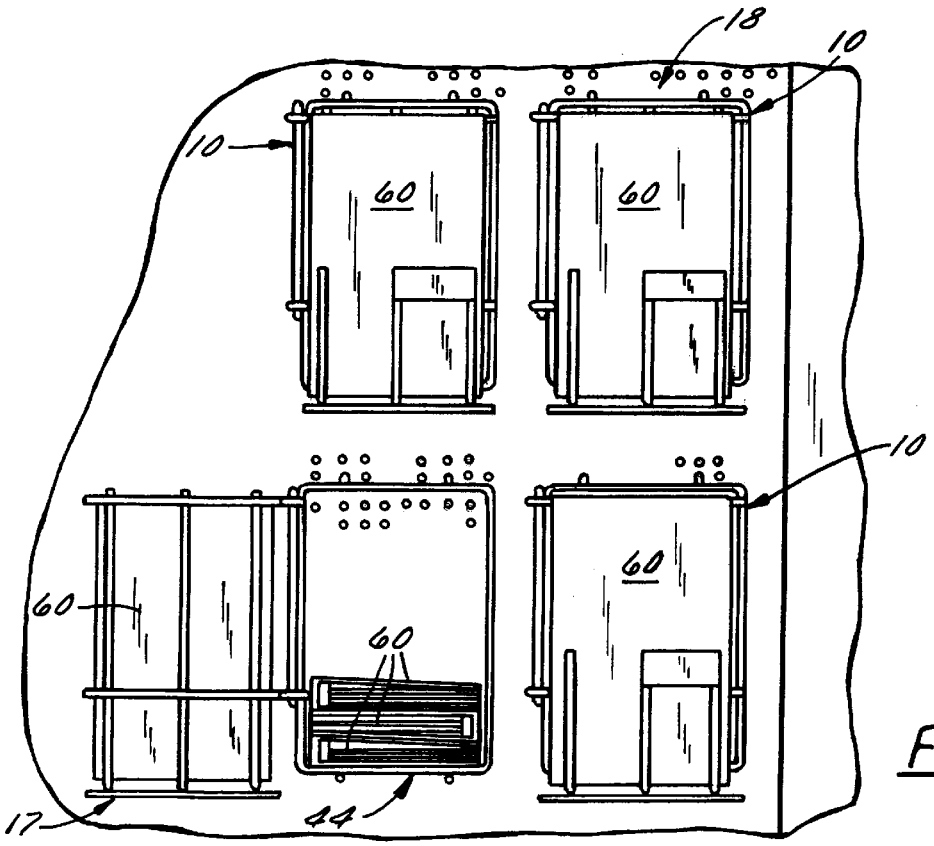
FIG. 6 is a view similar to FIG. 4 but showing photo album product in each of the four display and storage devices, with one of the four devices having its display portion open for removal of product.

FIGS. 5 and 6 show arrays of similarly sized display and storage devices 10. In the FIG. 5 illustration, all four of the display and storage devices 10 are shown in their closed position and are empty. Moreover, the four display and storage devices 10 are arranged in two rows of two devices 10, and a planar wall element 45 is shown at the right side of each horizontal row. It will be appreciated from this FIGURE that a planar wall element 45 is not required between adjoining devices 10 as the side wall of devices 10 formed by the vertical legs of rods 26*a*–26*c* will perform the same function for product held within storage portions 14. A similar view to FIG. 5 is shown in FIG. 6, but this FIGURE illustrates the opening of one display portion 17 to permit the removal of an album 60 from storage portion 14. Note also that in this FIGURE, the albums 60 are stored flat, rather than in the upstanding position illustrated in certain prior FIGURES and that planar wall elements 45 are also omitted from FIG. 6. This latter is to illustrate that if a perpendicular wall 64 adjoins peg board 18 at the appropriate location, the wall element need not be provided, as wall 64 can prevent product spillage.

Figure 7:
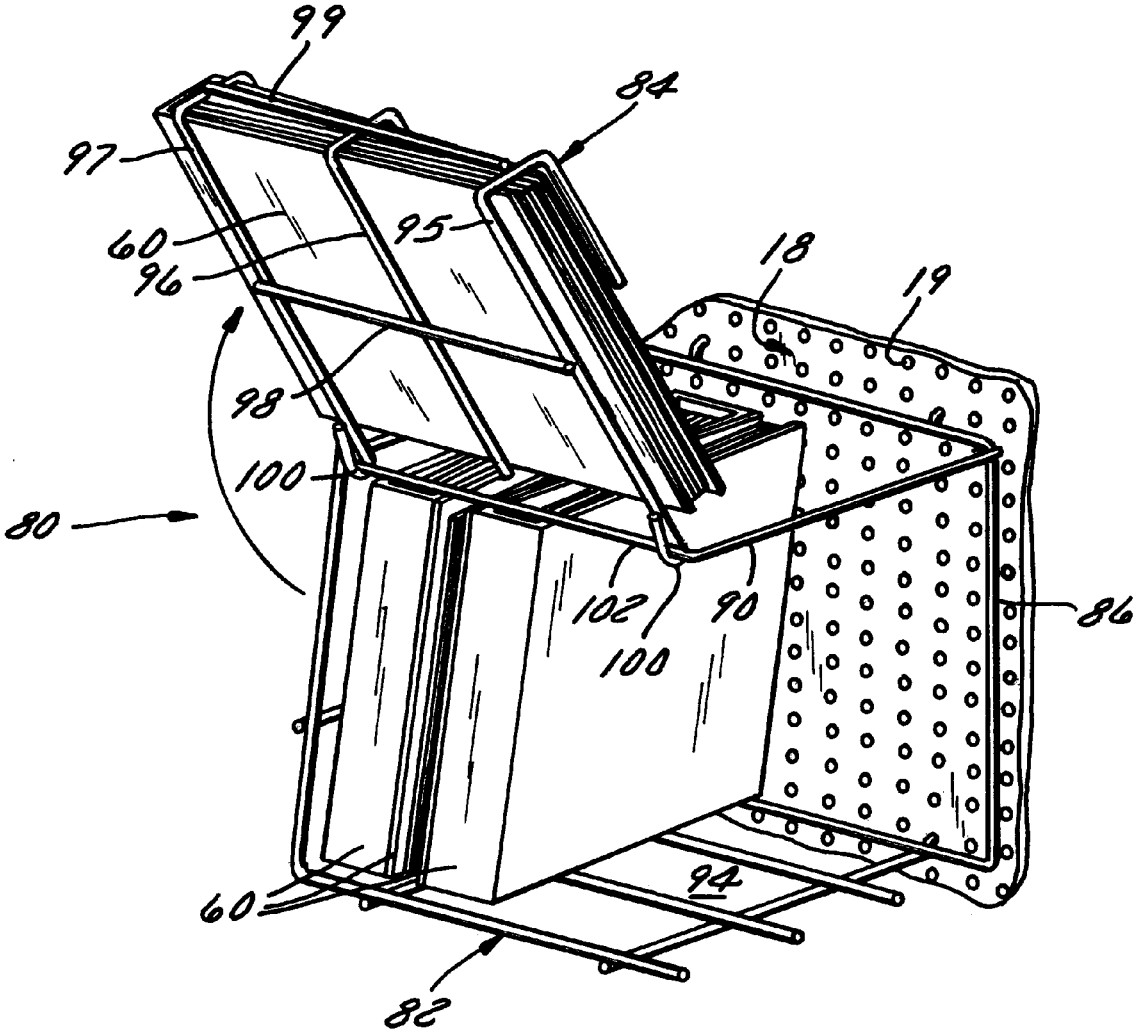
FIG. 7 is a perspective view of an alternate embodiment of the present invention in which the display portion is hinged to a top component of the storage portion.

An alternate embodiment of the present invention in shown in FIG. 7, wherein a display and storage device 80 includes a storage portion 82 and a display portion 84. Some of the components are the same as in the earlier embodiment and will not be described in detail. A rectangular frame 86 is provided at the rear edge of storage portion 82, and a rectangular top frame 90 extends parallel to and above the bottom 94 of the storage portion. A peg board wall 18 is shown in this FIGURE, and the rear frame 86 is coupled thereto in the manner previously described for display and storage device 10.

The display portion 84 is modified to the extent that three J-shaped rods 95, 96 and 97 are provided, together with two short connecting rods 98 and 99. The outside rods 95 and 97 include J hooks 100 at their upper ends, the hooks 100 extending about the forward leg 102 of the upper frame 90.

This embodiment achieves open position and access to the storage portion 82 by raising the display portion 84 about a horizontal hinge axis, but otherwise functions in the manner previously described for display and storage device 10.

While the present invention has been described in connection with a preferred and an alternate embodiment thereof, the invention is not to be limited thereby but is to be limited solely by the scope of the claims which follow.

What is claimed is:

1. A display and storage device including a storage portion and a display portion, the storage portion comprising a side wall having a front edge and a rear edge and a bottom having a front edge and a rear edge, the storage portion adapted for being coupled to a vertical wall, the display portion including a containment area for receiving an item to be displayed and an attachment edge, the attachment edge of the display portion being pivotally coupled to a front edge of the storage portion, whereby items may be stored behind the item being displayed and accessed by pivoting the display portion from a closed to an open position and wherein the front edge of the side wall extends farther from the rear edge than the front edge of the bottom, and wherein the display portion includes a back and a front, the display portion being movable between a first closed position in which the back contacts the front edge of the bottom and an open position in which the back lies in a plane which is parallel to a plane extending through the side wall.

2. The display and storage device of claim 1 further including a generally rectangular frame coupled to the rear edges of the storage portion for being attached to a vertical wall.

3. The display and storage device of claim 1 wherein peg board connectors are provided on the rear edges so that the device can be coupled to a vertical sheet of peg board.

4. The display and storage device of claim 1 wherein the front edge of the bottom of the storage portion is higher than the rear edge of the bottom of the storage portion when the storage portion is coupled to a vertical wall, so that the bottom of the storage portion is inclined upwardly from the vertical wall.

5. The display and storage device of claim 1 wherein the display portion is hinged to the front edge of the side wall.

6. The display and storage device of claim 1 further including a generally rectangular top frame for the storage portion which is spaced above and generally parallel to the bottom, the top frame having a front edge, the display portion being hinged to the front edge of the top frame.

7. The display and storage device of claim 1 wherein each of the storage and display portions are formed from spaced apart wire rods and the side wall and bottom are formed from a plurality of L-shaped wires which are generally parallel to each other and a plurality of wire rods extending generally perpendicularly toward the rear edge, the rods being connected to one another by welds.

8. The display and storage device of claim 7 further including a generally rectangular wire rod frame coupled to the rear edge of the storage portion for being attached to a vertical wall.

9. The display and storage device of claim 1 wherein the display portion is pivotally coupled to the front edge of the side wall.

10. The display and storage device of claim 1 wherein each of the storage and display portions are formed from spaced apart wire rods and the side wall and bottom of the storage portion are formed from a first plurality of L-shaped wires which are generally parallel to each other and a second plurality of wire rods extending generally perpendicularly to the first plurality of wire rods, the wire rods being connected to one another by welds.

11. The display and storage device of claim 10 further including a generally rectangular wire rod frame coupled to the rear edge of the storage portion for being attached to a vertical wall.

12. The display and storage device of claim 10 wherein a wire rod defines the front edge of the side wall and a pair of horizontally disposed parallel wire rods define the back of the display portion, each of the pair of parallel wire rods being bent approximately 90° away from the edge of the bottom at the ends thereof nearest the side wall, the terminal ends of the bent portions of the pair of parallel wire rods being further bent into J-hooks which surround the wire defining the front edge of the side wall to provide a hinged, pivotal connection between the display and storage portions.

13. The display and storage device of claim 12 wherein the bottom of the storage portion is inclined upwardly with respect to the rear edge of the storage portion to provide a gravitational hinge closing mechanism between the display and storage portions.

14. The display and storage device of claim 1 wherein the front of the display portion includes a planar surface for providing information about an item displayed therein.

15. A display and storage system comprising a vertical wall and a plurality of display and storage devices coupled thereto, each display and storage device including a storage portion and a display portion, the storage portion comprising a side wall having a front edge and a rear edge and a bottom having a front edge and a rear edge, the storage portion adapted for being coupled to the vertical wall, the display portion including a containment area for receiving an item to be displayed and an attachment edge, the attachment edge of the display portion being pivotally coupled to a front edge of the storage portion, whereby items may be stored behind the item being displayed and accessed by pivoting the display portion from a closed to an open position, and wherein the front edge of the side wall extends farther from the rear edge than the front edge of the bottom, and wherein the display portion includes a back and a front, the display portion being movable between a first closed position in which the back contacts the front edge of the bottom and an open position in which the back lies in a plane which is parallel to a plane extending through the side wall.

16. The display and storage system of claim 15 wherein at least two of the display and storage devices are coupled to the wall in a horizontal row and the side wall of one display and storage device is spaced apart from an adjacent display and storage device by a distance less than the width of the items to be displayed and stored, whereby the side wall of one such display and storage device is generally parallel and spaced apart from the side wall of the adjacent display and storage device to assist in retaining items stored in the adjacent display and storage device.

17. The display and storage device of claim 15 including at least one planar wall element coupled to the vertical wall and located adjacent to a display and storage device and spaced apart therefrom by a distance less than the width of the items to be displayed and stored, whereby the side wall of the display and storage device and the wall element are generally parallel to one another and assist in retaining the items stored in the display and storage device.

18. The display and storage system of claim 15 further including a generally rectangular frame coupled to the rear edges of the storage portion for being attached to the vertical wall.

19. The display and storage system of claim 15 wherein the wall is peg board and peg board connectors are provided on the rear edges.

20. The display and storage system of claim 15 wherein the front edge of the bottom of the storage portion is higher than the rear edge of the bottom of the storage portion when the storage portion is coupled to the vertical wall, so that the bottom of the storage portion is inclined upwardly from the vertical wall.

21. The display and storage system of claim 15 wherein the display portion is hinged to the front edge of the side wall.

22. The display and storage system of claim 15 further including a generally rectangular top frame for the storage portion which is spaced above and generally parallel to the bottom the top frame having a front edge, the display portion being hinged to the front edge of the top frame.

23. The display and storage system of claim 15 wherein each of the storage and display portions-are formed from spaced apart wire rods and the side wall and bottom are formed from a plurality of L-shaped wires which are generally parallel to each other and a plurality of wire rods extending generally perpendicularly toward the wall, the rods being connected to one another by welds.

24. The display and storage system of claim 23 further including a generally rectangular wire rod frame coupled to the rear edge of the storage portion for being attached to the vertical wall.

25. The display and storage system of claim 15 wherein the display portion is pivotally coupled to the front edge of the side wall.

26. The display and storage system of claim 15 wherein each of the storage and display portions are formed from spaced apart wire rods and the side wall and bottom of the storage portion are formed from a plurality of L-shaped wires which are generally parallel to each other and a plurality of wire rods extending generally perpendicularly toward the rear edge of the bottom, the rods being connected to one another by welds.

27. The display and storage system of claim 26 further including a generally rectangular wire rod frame coupled to the rear edge of the storage portion for being attached to the vertical wall.

28. The display and storage system of claim 26 wherein a wire rod defines the front edge of the side wall and a pair of horizontally disposed parallel wire rods define the back of the display portion, each of the pair of parallel wire rods being bent approximately 90° away from the rear edge of the bottom at the ends thereof nearest the side wall, the terminal ends of the bent portions of the pair of parallel wire rods being further bent into J-hooks which surround the wire defining the front edge of the side wall to provide a hinged, pivotal connection between the display and storage portions.

29. The display and storage system of claim 28 wherein the bottom of the storage portion is inclined upwardly with respect to the rear edge of the storage port n to provide a gravitational hinge closing mechanism between the display and storage portions.

30. The display and storage system of claim 15 wherein the front of the display portion includes a planar surface for providing information about an item displayed therein.

31. A display and storage system for items having a predetermined width comprising a plurality of display and storage devices mounted to a vertical wall, each display and storage device consisting essentially a storage portion consisting essentially of a generally planar side wall perpendicular to the vertical wall and having a front edge and a rear edge and a generally planar bottom having a front edge and a rear edge, the rear edges being coupled to the vertical wall and the bottom having a width, and each display and storage device including a display portion hinged to a front edge of the storage portion and movable between a closed position in which access to the storage portion is restricted and an open position in which access to the storage portion is facilitated, and wherein at least two of the display and storage devices are coupled to the wall in a horizontal row and the side wall of one such display and storage device is spaced apart from the side wall of an adjacent display and storage device by a distance less than twice the width of the bottom, whereby the side wall of one such display and storage device is generally parallel and spaced apart from the side wall of the adjacent display and storage device to assist in retaining the items stored in the adjacent display and storage device.

32. The system of claim 31 wherein the storage portion and the display portion are each made from a plurality of parallel and a plurality of intersecting wire rods, the rods being welded to each other at points of intersection.

33. The system of claim 31 wherein a plurality of items to be stored are located in the storage portion and an item to be displayed is located in the display portion.

34. The system of claim 33 wherein the front edge of the side wall is inclined with respect to the vertical wall and the display portion is hinged to the front edge of the side wall and is urged by gravity toward its closed position from its open position.

35. The system of claim 33 wherein the items stored and the item displayed are each photograph albums.

36. The system of claim 31 wherein the bottom has a width greater than ½ of the predetermined width of the items to be stored therein.

37. The display and storage device of claim 31 including at least one planar wall element coupled to the vertical wall and located adjacent to a display and storage device and spaced apart therefrom by a distance less than the width of the items to be displayed and stored, whereby the side wall of the display and storage device and the wall element are generally parallel and assist in retaining the items stored in the display and storage device.

38. A display and storage device including a storage portion and a display portion, the storage portion comprising a side wall having a front edge and a rear edge and a bottom having a front edge and a rear edge, the storage portion adapted for being coupled to a vertical wall, the display portion including a front, a back, and a containment area for receiving an item to be displayed and an attachment edge, the attachment edge of the display portion being pivotally coupled to the front edge of the storage portion, whereby items may be stored behind the item being displayed and accessed by pivoting the display portion from a closed to an open position;

each of the storage and display portions being formed from spaced apart wire rods, and the side wall and bottom of the storage portion are formed from a plurality of L-shaped wires which are generally parallel to each other and a plurality of wire rods extending generally perpendicularly toward the rear edge of the bottom, the rods being connected to one another by welds;

a wire rod defining the front edge of the side wall and a pair of horizontally disposed parallel wire rods defining the back of the display portion, each of the pair of parallel wire rods being bent approximately 90° away from the rear edge of the bottom at the ends thereof nearest the side wall, the terminal ends of the bent portions of the pair of parallel wire rods being further bent into J-hooks which surround the wire defining the front edge of the side wall to provide a hinged, pivotal connection between the display and storage portions; and wherein the wire defining the front edge of the side wall is inclined rearwardly from its bottom to its top to provide a gravitational hinge closing mechanism between the display and the storage portions.

39. A display and storage system comprising a vertical wall and a plurality of display and storage devices coupled thereto, each display and storage device including a storage portion and a display portion, the storage portion comprising a side wall having a front edge and a rear edge and a bottom having a front edge and a rear edge, the storage portion adapted for being coupled to the vertical wall, the display portion including a front, a back, and a containment area for receiving an item to be displayed and an attachment edge, the attachment edge of the display portion being pivotally coupled to the front edge of the storage portion, whereby items may be stored behind the item being displayed and accessed by pivoting the display portion from a closed to an open position;

each of the storage and display portions being formed from spaced apart wire rods, and the side wall and bottom of the storage portion are formed from a plurality of L-shaped wires which are generally parallel to each other and a plurality of wire rods extending generally perpendicularly toward the wall, the rods being connected to one another by welds;

a wire rod defining the front edge of the side wall and a pair of horizontally disposed parallel wire rods defining the back of the display portion, each of the pair of parallel wire rods being bent approximately 90° away from the rear of the bottom at the ends thereof nearest the side wall, the terminal ends of the bent portions of the pair of parallel wire rods being further bent into J-hooks which surround the wire defining the front edge of the side wall to provide a hinged, pivotal connection between the display and storage portions; and wherein the wire defining the front edge of the side wall is inclined rearwardly from its bottom to its top to provide a gravitational hinge closing mechanism between the display and the storage portions.

* * * * *